US005163367A

United States Patent [19]

Newman

[11] Patent Number: 5,163,367

[45] Date of Patent: Nov. 17, 1992

[54] METHOD AND APPARATUS FOR LINEAR ADJUSTMENT OF PRINTING FRAME

[75] Inventor: Don E. Newman, Wyncote, Pa.

[73] Assignee: Stretch Devices, Inc., Philadelphia, Pa.

[21] Appl. No.: 793,307

[22] Filed: Nov. 14, 1991

Related U.S. Application Data

[63] Continuation of Ser. No. 403,544, Sep. 6, 1989, abandoned.

[51] Int. Cl.[5] ..... B41F 15/34

[52] U.S. Cl. ..... 101/127.1; 38/102.3

[58] Field of Search ..... 101/127.1, 128.1, 128.4; 38/102, 102.1, 102.3, 102.4, 102.5, 102.6, 102.91; 160/374, 374.1, 381; 69/19.3

[56] References Cited

U.S. PATENT DOCUMENTS 3,601,912 8/1971 Dubbs ..... 38/102.91
3,908,293 9/1975 Newman ..... 38/102.91
3,914,887 10/1975 Newman ..... 38/102.8
4,345,390 8/1982 Newman ..... 38/102.91
4,525,909 7/1985 Newman ..... 38/102.91
4,549,596 10/1985 Staro ..... 160/374.1

OTHER PUBLICATIONS

Screen Tensioning by Tamas Frecska pp. 48–53, 110–112 Feb. 1984, Screen Printing.

*Primary Examiner*—Edgar S. Burr
*Assistant Examiner*—Ren Yan
*Attorney, Agent, or Firm*—Seidel, Gonda, Lavorgna & Monaco

[57] ABSTRACT

A method and apparatus for screen tensioning and printing using a frame including rollers having a screen secured thereto. Each roller is supported at opposite ends for rotation about its longitudinal axis to transversely tension the screen substantially equally along the length of the roller. The printed image being linearly varied by adjusting the relative position of the ends of the roller and thereby adjusting the linear tension of the screen to accommodate for the tolerances created within the screen setup and the printing process.

12 Claims, 6 Drawing Sheets

FIG. 1
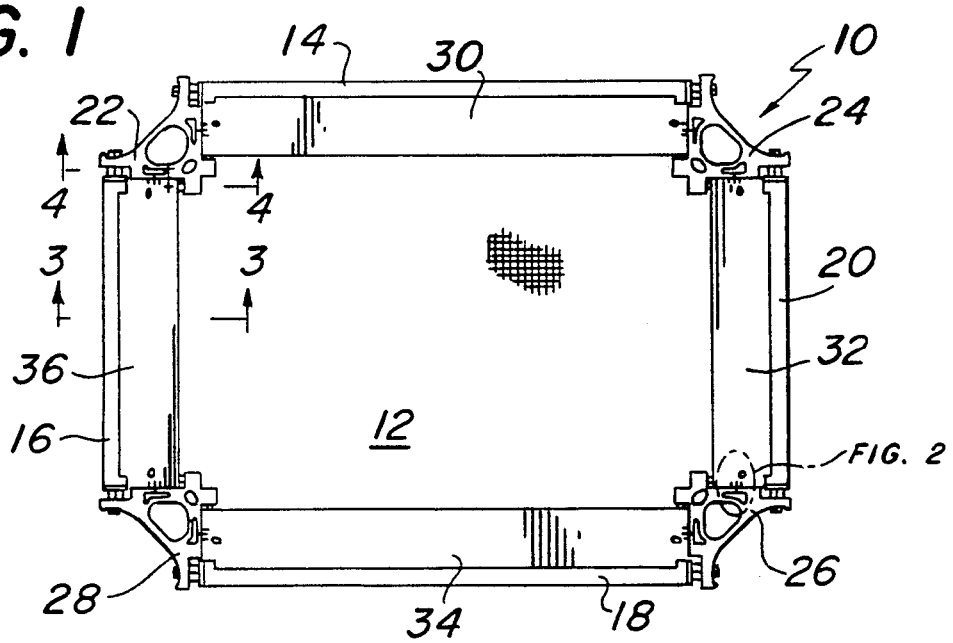
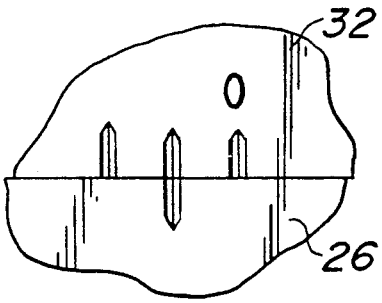
FIG. 2
FIG. 3
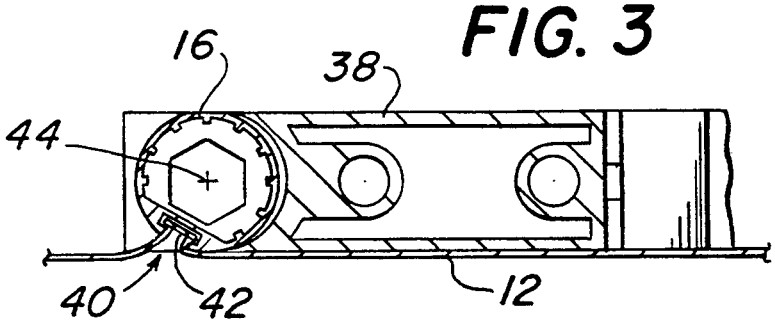
FIG. 4
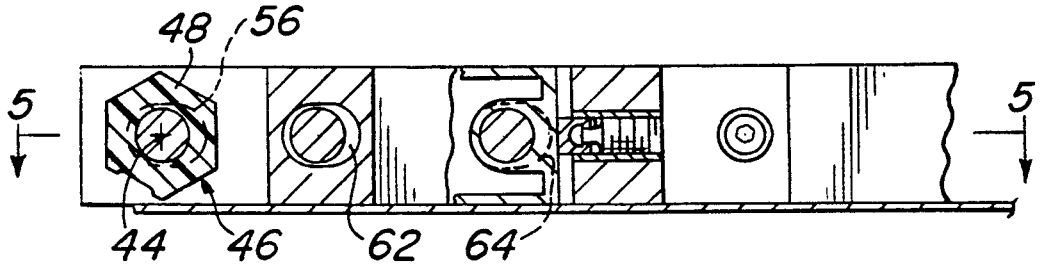

FIG. 7
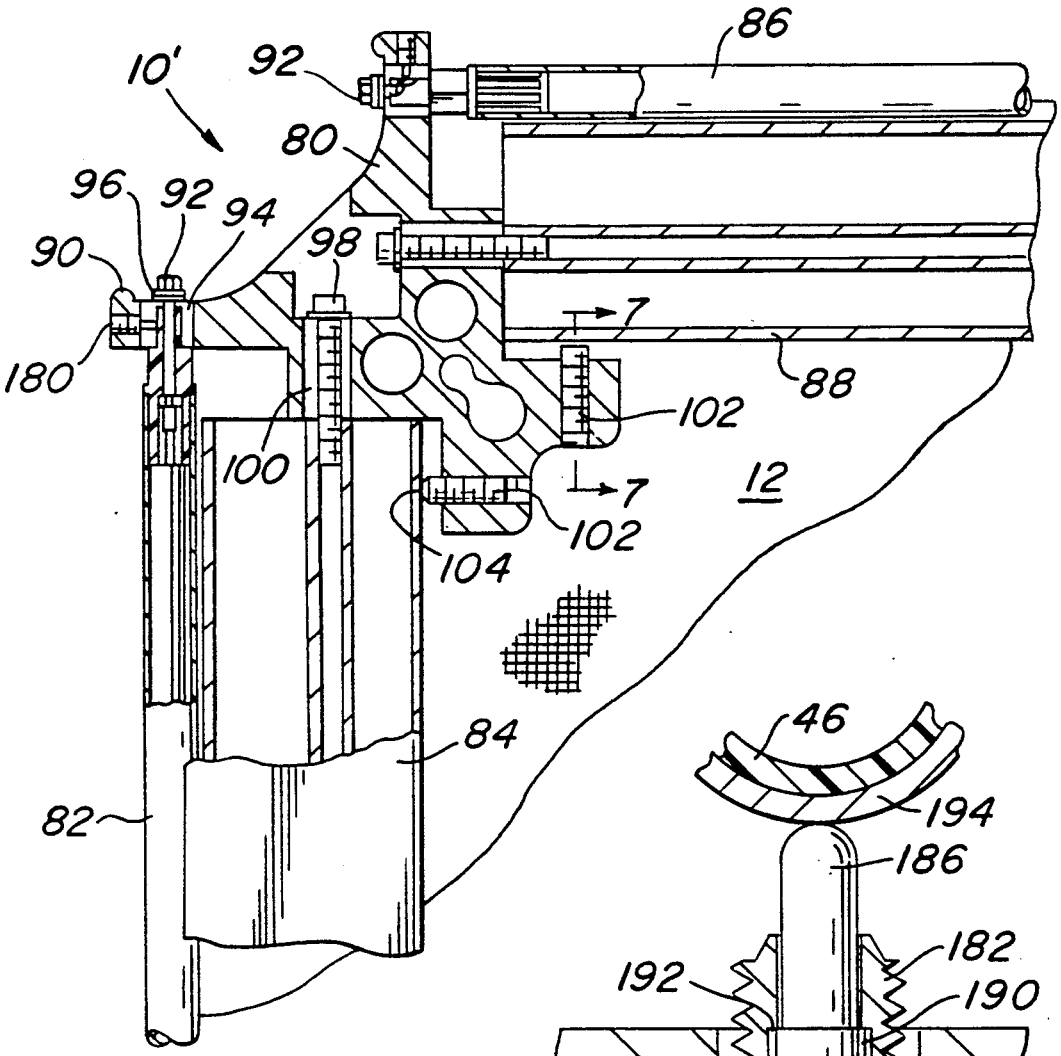
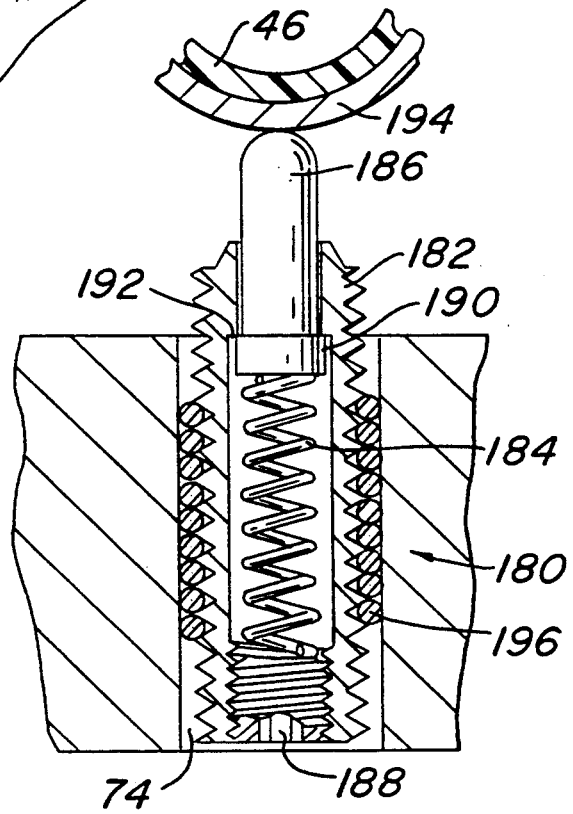
FIG. 6

FIG. 9
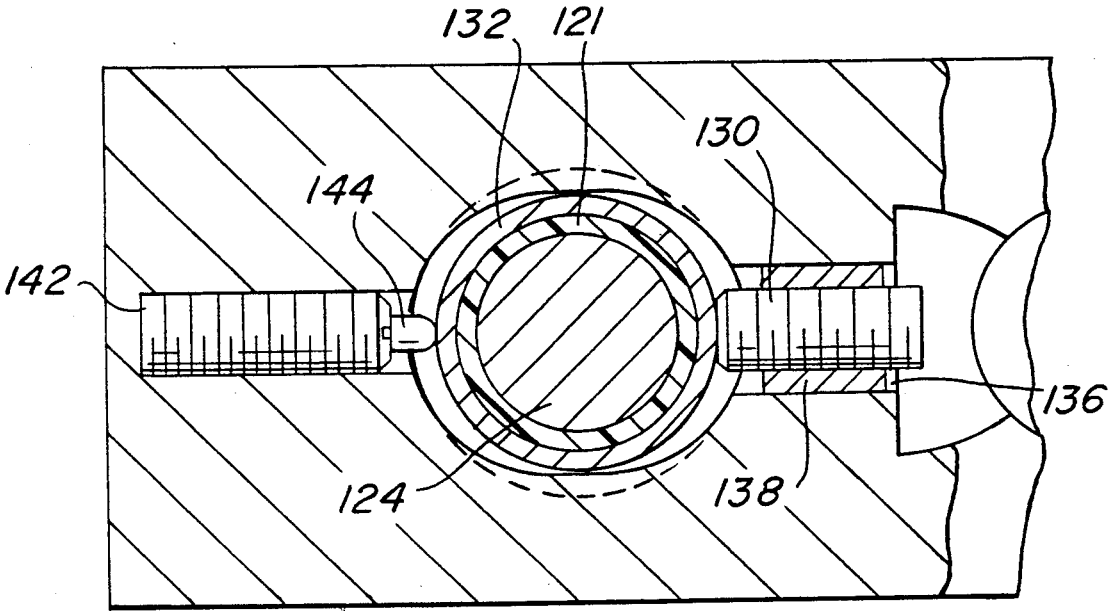
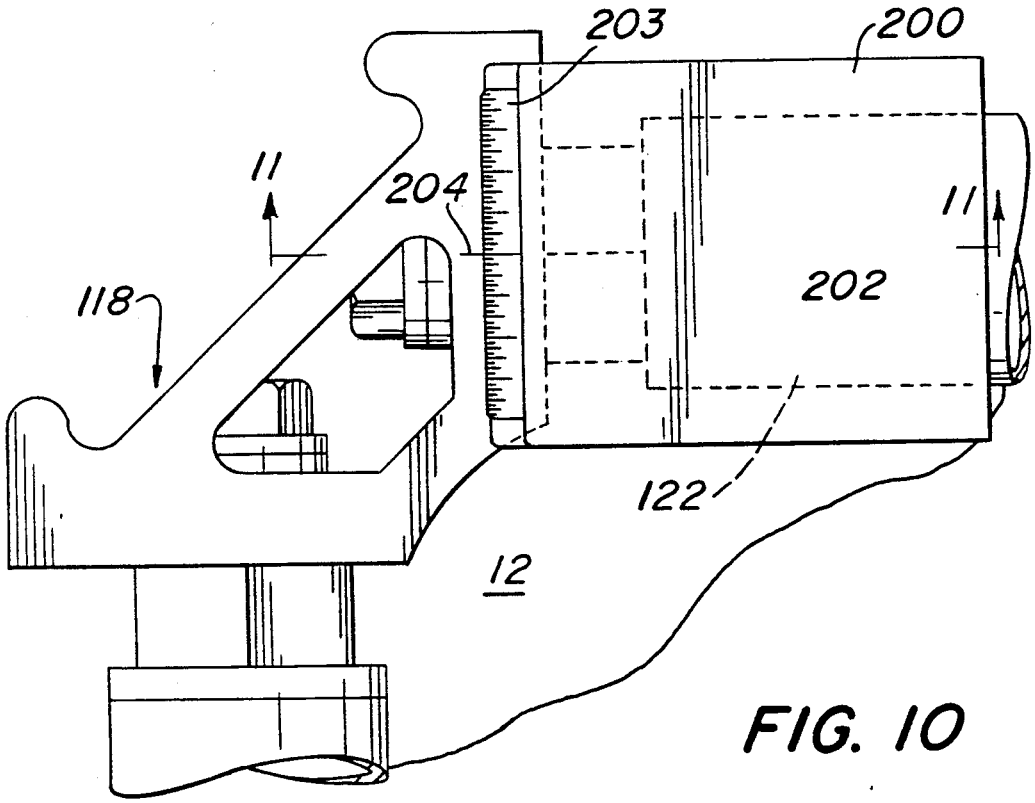
FIG. 10

METHOD AND APPARATUS FOR LINEAR ADJUSTMENT OF PRINTING FRAME

This is a continuation of application Ser. No. 07/403,544, filed Sept. 6, 1989, now abandoned.

BRIEF SUMMARY OF THE INVENTION

The present invention relates to a screen tensioning and printing frame of the type including at least one roller having means for securing a screen or fabric thereto and for transversely tensioning the fabric of the screen substantially equally along the length of the roller. The invention is particularly directed to adjusting the relative end-to-end position of the roller to linearly vary the tension in the screen from one end of the roller to the opposite end thereof. The invention also relates to a method of compensating for the accumulation of tolerances within the normal screen printing process to produce an exact image upon printing.

BACKGROUND OF THE INVENTION

In screen printing processes a woven screen or fabric material is used for printing by forcing ink through the interstices of the weave or mesh. A wide range of fabrics may be used with thicknesses between 0.001 and 0.020 inch and with thread counts varying from 12 to 600 per inch. The image to be printed is permanently formed on the screen by blocking or stenciling certain of the interstices using a photo etching process or the like. To achieve high quality results with good registration and resolution, it is necessary for the screen to be maintained stable and high under tension. A frame that can stretch a screen equally along the linear length of at least one side thereof to any desired tension and can maintain the screen in that condition during printing is shown in U.S. Pat. Nos. 3,601,912 and 4,525,909.

One problem associated with screen printing of the type heretofore mentioned, particularly within the processes that require high accuracy and precision in the ultimate image, is the misalignment of the printed image. This misalignment is likely due to a number of factors and tolerances that can change during each print. The misalignments in the printed image may be created during () the formation of the original image or artwork which may not be dimensionally correct to the desired image to be reproduced, (2) the formation of a film positive art work which may vary in dimension as compared to the original art work due to temperature and humidity considerations or due to camera technique, (3) the burning of the stencil into the stretched screen which may cause dimensional changes in the ultimate image (even if the original art and the film positive image are perfect dimensionally), (4) the application of the ink onto the screen via the squeegee which stretches the screen so as to contact with the printing surface and elongates the image on the screen (although higher screen tension greatly minimizes, or substantially eliminates, this factor in contributing to the tolerance accumulation), (5) the printing process due to temperature and humidity considerations on the stencil, (6) the printing process due to the variation of the printing surface substrate because of temperature and humidity considerations and the ink curing process, (7) the printing process due to creep and fatigue that is inherent in the dynamic force loads of the process, etc.

The variation in the ultimate printed image from that of the original art work or desired image has been noted to be substantially linear along the sides of the image. These variations are considered highly significant when printing multiple colors or color sheets, or images that must align to subsequent manufacturing steps, such as die cutting, embossing, drilling, folding, etc., since one sheet may be misaligned with respect to another.

SUMMARY OF THE INVENTION

The present invention is a screen tensioning and printing apparatus and a method of printing that includes compensating for the accumulation of tolerances that create misalignments or variations within the ultimate printed image.

The apparatus includes a frame having at least one member thereon, such as a roller, for tensioning the screen. The tensioning member typically includes means for locking the screen thereto. The roller is rotated about its longitudinal axis to transversely tension the screen substantially equally along its length. The present invention further provides means for adjusting the relative end position of the roller on the frame to linearly vary the tension in the screen along the length of the roller. The adjustment means serves to linearly reapportion the printed image to accommodate for the various tolerances involved in the printing process. Also, adjustment may be made to compensate for minute variations in the screen fabric or its attachment to the printing frame that create variations in fiber tension from position to position. Thus, the ultimate printed image may be adjusted as part of each application to produce highly accurate printed articles.

The method of the present invention includes supporting a screen on a printing frame and tensioning the screen substantially equally along the length of at least one side of the frame. The printing frame is then adjusted to vary the image on the screen. This adjustment linearly reapportions the printed image. Adjustment can be made at one end or, on a frame having four variable sides, at up to sixteen positions. Preferably the screen is returned to the neutral or starting position after printing. This removes the variations in tension within the screen and prevents the introduction of additional distortions to the screen which further varies the printed image from that desired during subsequent prints. The image produced by this method may be reapportioned to exactly match the original artwork, desired image or desired image colors.

BRIEF DESCRIPTION OF THE DRAWINGS

For purposes of illustrating the invention, there is shown in the drawings a form which is presently preferred. It being understood, however, that this invention is not limited to the precise arrangements and instrumentalities shown.

FIG. 1 is a plan view of a screen tensioning and printing frame incorporating the present invention.

FIG. 2 is a partial enlargement thereof.

FIG. 3 is a cross-sectional view thereof taken along line 3—3 in FIG. 1.

FIG. 4 is a cross-sectional view thereof taken along line 4—4 in FIG. 1.

FIG. 6 is a partial cross-sectional view taken along line 6—6 in FIG. 5.

FIG. 7 is a cross-sectional view of an alternate embodiment of the present invention.

FIG. 9 is a partial cross-sectional view thereof taken along line 9—9 in FIG. 8.

FIG. 10 is a top plan view of a measurement scale for use as part of the present invention.

DETAILED DESCRIPTION OF THE DRAWINGS

Figure 5:
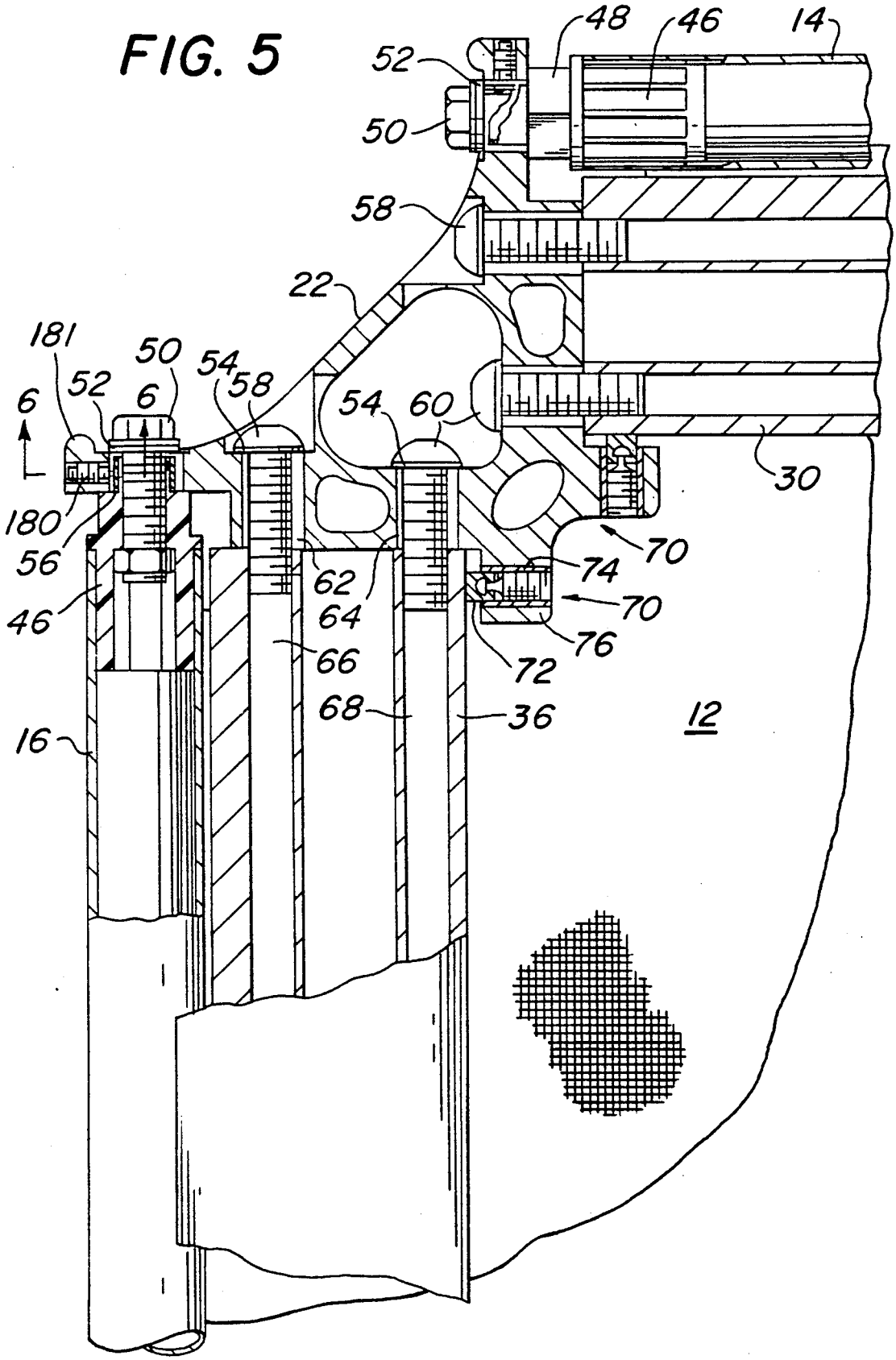
FIG. 5 is a cross-sectional view thereof taken along line 5—5 in FIG. 4.

Referring to the drawings in detail where like numerals indicate like elements, there is shown in FIG. 1 a screen tensioning and printing frame designated generally as 10. The frame 10 includes a screen 12 mounted on the rear face thereof. The screen 12 may be made of a wide range of fabrics or materials having thicknesses typically between 0.001 and 0.020 inch and thread counts varying from 12 to 600 per inch. The frame 10 is preferably capable of handling fabrics across this entire range and maintaining a uniform tension within each of the threads.

The structural elements of the frame 10 include a plurality of side members, shown as rollers, designated as elements 14, 16, 18 and 20. Each of the rollers 14–20 are supported for rotation at their ends by respective corner members 22, 24, 26 and 28. Rollers 14 and 18 are positioned substantially parallel to each other. Rollers 16 and 20 are also substantially parallel to each other and are mutually perpendicular to rollers 14 and 18. Rollers 14–20 are preferably hollow extrusions made from a light-weight, non-corrosive material, such as aluminum. The corner members 22–28 are rigid and also preferably made from a light-weight, non-corrosive material such as aluminum, steel or plastic.

The frame 10 illustrated in FIG. 1 also includes a plurality of box beams designated as 30, 32, 34 and 36. The purpose of the box beams 30–36 is to minimize excessive inward bowing of the rollers 14–20 under the tension of the screen 12. An example of a box beam structure as contemplated herein is disclosed in U.S. Pat. No. 4,345,390. Alternately, a pre-stressing means (not shown) extending between adjacent corner members may be used for applying a camber to the associated roller. Such a pre-stressing means is disclosed in U.S. Pat. No. 3,908,293. Other means having a similar structure or producing the same result, may also be utilized and are contemplated for use herewith.

As will be discussed herein further, the corner members and rollers may take various forms depending on the size of the frame and the tension of the screen. In each particular embodiment of the printing frame discussed herein, the rollers, corner members and box beams are substantially identical. Hence, in the embodiment shown in FIGS. 1–6, rollers 14 and 16, box beams 30 and 36 and corner member 22 will be discussed in detail as representative of the other similar members in the frame 10.

FIGS. 3–6 show the relationship between roller 16, box beam 38 and corner member 22 as they are assembled to form frame 10. Roller 16 includes means to lock the screen 12 thereto. This locking means includes a longitudinally extending peripheral groove 40 having a locking strip 42 therein. The roller 16 and groove 40 may be formed in the manner described in U.S. Pat. No. 4,525,909 so as to accommodate for the range of fabrics. Any tendency of the screen 12 to pull out of the groove 40 will force locking strip 42 to pivot and contact the internal surfaces of groove 40. An increase in tension in the screen 12 will result with an increase in the pivot force by strip 42, and increase the force holding the fabric within the groove 40. Thus, roller 16 may be rotated about its longitudinal axis 44 to attain a desired tension in the screen 12.

At each end of roller 16 is provided means for rotating the roller 16 about its longitudinal axis 44. As illustrated in FIG. 4, the rotating means takes the form of an end cap 46 having a hexagonal nut 48 formed thereon. Roller 16 may be rotated about its axis 44 by a wrench or the like (not shown) which engages the surfaces of the nut 48. As shown in FIG. 5, the roller 16 is attached to the corner member 22 by means of a machine screw or bolt 50. Bolt 50 passes through an opening 56 within the end thereof. Bolt 50 engages an internal thread within the end cap 46. Thus, by tightening bolt 50 into the end cap 46, the roller 16 is locked to the corner member 22, preventing rotation and transverse movement thereof. The locking force of the bolt 50 against the corner member 22 is borne by washers 52.

Box beam 36 is attached to corner member 22 and fixed in position adjacent the periphery of roller 16 by bolts 58 and 60. Bolts 58, 60 are inserted through openings 62 and 64, respectively, on the same side as opening 56 for bolt 50. Bolts 58, 60 engage internal threads within passages 66 and 68 within the box beam 36. The locking force of bolts 58, 60 on corner member 22 is borne by washers 54.

Openings 56, 62 and 64 in corner member 22 are preferably elliptical or elongated. This formation permits the bolts 50, 58 and 60, when unlocked, to move along the edge of the corner member 22. Thus, the position of the ends of the roller 16 and the box beam 36 in the frame 10 may be adjusted.

In order to fix the position of the roller 16 and the box beam 36 there is provided an adjustment means 70 in the form of a screw. As shown particularly in FIG. 5 and 6, means 70 includes a bearing head 72 for contacting the inside surface of box beam 36 and is positioned within a threaded opening 74 in extension arms 76 of corner member 22. The bearing head 72 is press fit onto a rounded support forming the upper end of the screw 70. This support permits the head 72 to "swivel". Thus, adjustment means 70 permits the bearing surface to remain flush with the surface of the box beam 36 at all relative angular positions. Also, the bearing head 72 will not rotate along with the bottom of the screw 70.

A biasing means 180 is secured within the end flange 181 of corner member 22. As particularly illustrated in FIG. 6, the biasing means 180 includes a threaded shaft 182 having a tubular opening therein. Included within the opening is a coiled spring 184 having a head 186 projecting from the top of the shaft 182. A threaded plug 188 is provided in the opposite end of the shaft 182 for purposes of supporting the end of the spring 186. Spring 184 is normally compressed between the head 186 and plug 188. The plug includes a base portion 190 which abuts against an inwardly projecting shoulder 192 within the opening in shaft 182. Threaded shaft 182 is inserted into opening 74 within the corner member 22 by any desired means. As illustrated, the threaded shaft 182 engages a helical spring 196 which in turn engages the side walls of the opening 74 to fix the shaft 182 within the opening in corner member 22.

Biasing means 180 provides an inwardly directed resilient force against the roller 16, opposite of the force of the adjustment means 70. The end of the roller 16 includes a metal sleeve, 194 or the like to prevent depression of the plug 188 in the plug material. Upon rotation of the adjustment means to move the box beam 36 and roller 16 inwardly (i.e. toward the center of the frame) the force of the spring 184 will also move the box beam 36 and rollers 16 in an inward direction. Thus, the box beam 36 and roller 16 will not bind against the surfaces of the corner member 22 and will move incrementally according to the adjustment of means 70.

Due to tolerances created within the screen setup and the printing process (discussed above), the ultimate printed image may require adjustment to produce an exact image or to improve image registration. It has been determined that the tolerances often create variations in the image which are substantially linear along the side length of the image. Therefore, by incrementally moving the adjustment screw 70, inwardly or outwardly, within the opening 74, the relative position of one end of the roller 16 and box beam 36 (on corner 22) with respect to the oppositely mounted ends thereof (on corner 28) can be varied to accommodate the misalignments in the printed image from that desired. Since adjustment screws 70 are provided on opposite ends of the box beam 36 and roller 16, these linear adjustments can be magnified by movement of each end of the roller 16 in opposite directions, or can be varied in degree by movement in concert. In the embodiment shown, each roller 14–20 and box beam 30–36 are contemplated to have an adjustment means 70 on each end thereof. Thus, the linear misalignments of all sides of the image can be made.

As is illustrated in FIG. 2, a scale may be provided on the adjacent portions of box beam 32 and corner member 26. The scale indicates the incremental amount of linear end-to-end adjustment. The roller 20 and box beam 32 are preferably positioned perpendicular to one another when the setting on box beam 32 is aligned with the center mark on the corner member 26. Thus, the amount of transverse variation within the screen 12 along the length of box beam 32 and roller 20 can be controlled, quantified and recorded. It is also desired that the screen 12 be returned to the zero position upon changing screens, or upon finishing the printing run, and after the current image is reclaimed. The zero position is preferably identified by the scale. The zero setting procedure will substantially eliminate the effects of uneven tension or creep within the fabric strands of the screen 12.

An alternate embodiment of a frame 10' as contemplated by the present invention is illustrated in FIG. 7. Corner member 80 serves to support roller 82 and box beam 84 perpendicular to a roller 86 and box beam 88. Frame 10 shown in FIGS. 1–6 is distinguished from frame 10' in that the associated size of the box beams 84, 86 is smaller. Again for illustration purposes only roller 82 and box beam 84 will be discussed.

Roller 82 is supported on the projected ends 90 of the corner member 80 by bolt 92 extending through opening 94. Washers 96 are provided as bearing surfaces for the force of the bolt 92 when locking the roller 82 to the corner member 80. Likewise, bolt 98 extends through opening 100 within the corner member 80 to set the position of the box beam 84. Due to the reduction in size of the roller 82 and box beam 84, as well as the overall dimensions of the frame 10', only a single bolt 98 is contemplated to fix the position of the box beam 84 on the corner member 80.

An adjustment means 102 for setting the linear end-to-end position of the roller 82 is provided in the form of a screw having a flat bearing head 104. Biasing means 180 provides an inwardly directed force on the roller in response to a corresponding rotation of the screw 102. In this regard, the embodiment shown in FIG. 7 works substantially the same as that shown in FIG. 6.

Figure 8:
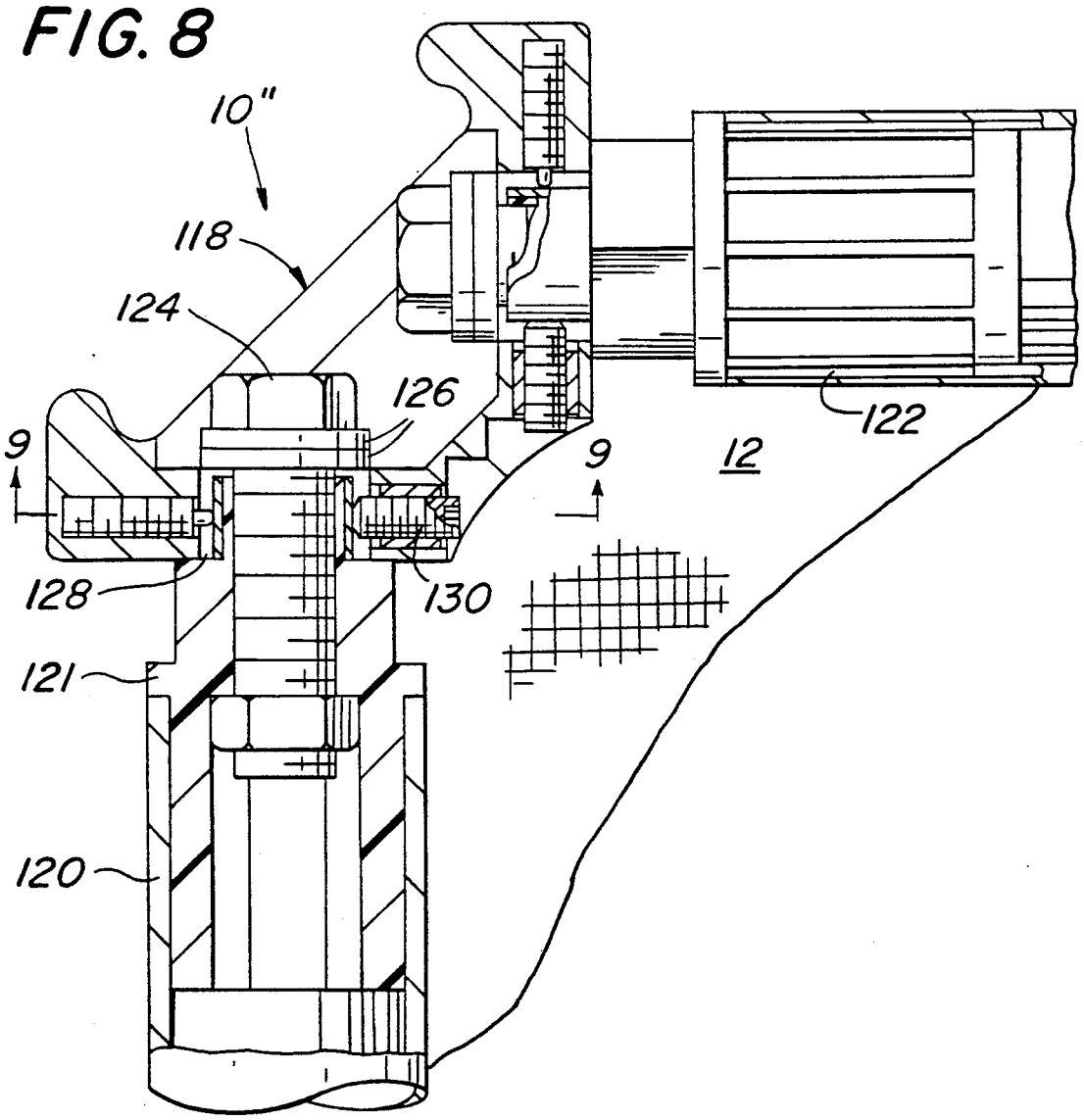
FIG. 8 is a cross-sectional view of a second alternate embodiment of the present invention.

Illustrated in FIGS. 8 and 9 is a second alternate embodiment of a frame 10'' contemplated by the present invention. Frame 10'' again differs from those previously discussed in that the relative size of the screen 12 is further reduced such that a box beam is not required to support the rollers 120 and 122 (as shown) when the screen 12 is under tension.

As particularly illustrated in FIG. 8 a corner member 118 supports one end of rollers 120 and 122. Roller 120 is supported on corner member 118 by means of bolt 124 which extends through an opening 128. Washers 126, positioned between the head of the bolt 124 and the opening 128, provide a bearing surface for the locking force of the bolt 124. Adjustment means 130 is positioned within the internal corner of member 118 and bears against the end plug 121 of roller 120 having a collar 132, thereon. An insert 138 may be provided within opening 136 to form the threaded engagement between screw 130 and corner member 118. A biasing means 142 is provided on the opposite side of the roller 120 from the contact by the adjustment means 130. Biasing means 142 substantially comprises a threaded insert having a projecting bearing head 144. This bearing head 144 contacts the roller 120 in a manner similar to insert 180. Biasing means 142 is provided as an alternative to washers that would slide more freely across the bearing surface on corner member 118 or the hardening of these bearing surfaces. The counter biasing provided by means 142 permits the roller 120 to move continuously with the incremental adjustment of means 130 and provides a force other than the fabric tension.

It should be noted that any of the adjustment means 70, 102 or 130 contemplated herein, may be used in any of the frame embodiments 10, 10', 10'' illustrated or as otherwise contemplated. These multiple embodiments are also provided by way of example of other structures which may become apparent to those skilled in the art for accomplishing an equivalent purpose. Furthermore, any number of rollers or equivalently functioning members may be utilized within a screen printing frame to provide necessary tension within the screen 12.

Figure 11:
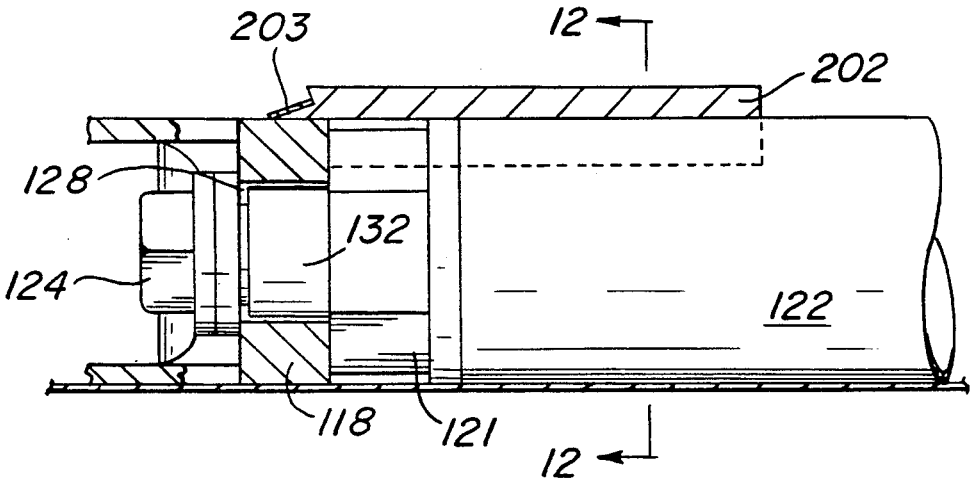
FIG. 11 is a cross-sectional view thereof as taken along line 11—11 in FIG. 10.
Figure 12:
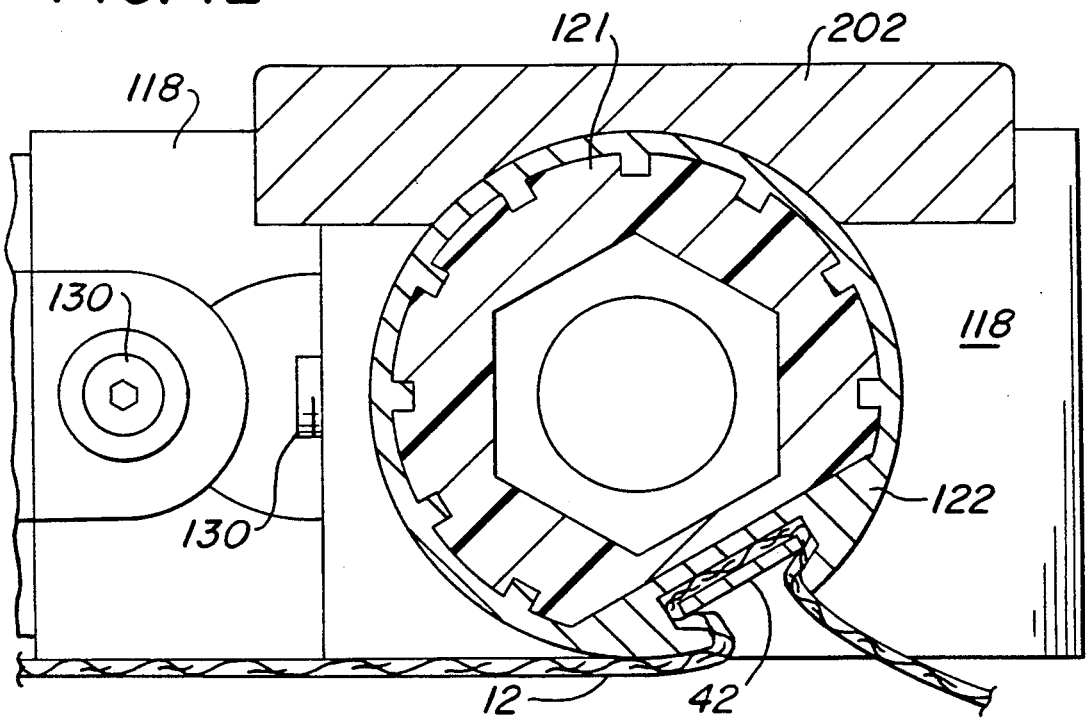
FIG. 12 is a cross-sectional view thereof as taken along line 12—12 in FIG. 11.

As illustrated in FIG. 2, it is desired that a means be provided to indicate the incremental adjustment of the roller 20 and provide a means for indicating the return of the roller 20 to its zero or perpendicular position on the frame. Illustrated in FIGS. 10–12 is an alternate embodiment of a measurement scale and is identified by the numeral 200. Although scale 200 may be applied to any of the embodiments of the frame shown herein, such is preferably adapted to frame 10'' in FIGS. 8 and 9.

The measurement scale 200 generally includes a plate 202 or the like having a projected end including a rule 203 thereon. The rule 203 on scale 200 in its rest or zero position aligns with center position 204 on the corner member 118. The bottom portion of the plate 202 includes a circular indentation which matches to the curvature of the roller 122, thus, when the roller 122 is adjusted by adjustment means 130, the plate 202 moves in the same direction along the surface of the corner member 118 to illustrate incremental adjustment relative to the position of line 204 on the corner member 118. Plate 202 may also be easily removed from the printing frame.

The present invention may be embodied in other specific forms without departing from the spirit or essential attributes thereof and, accordingly, reference should be made to the appended claims, rather than to the foregoing specifications, as indicating the scope of the invention.

I claim:

1. A screen tensioning and printing frame comprising: a screen having an image to be printed thereon; a series of rollers attached to the screen on opposite sides of the image to be printed and for tensioning the screen; corner members for supporting the rollers at opposite end; means for locking the rollers to the corner members, the locking means preventing the rotation of the roller and fixing the position of the roller at a predetermined tension in the screen; and means for reapportioning the printed image on the screen by adjusting the position of the rollers on the corner members, the reapportioning means comprising a set screw mounted within the corner member and having a bearing head to fix the relative position of the roller and its attachment to the corner member.

2. A screen tensioning and printing frame as claimed in claim 1 further comprising means for at least partially opposing undesired inward bowing of the rollers under the tension of the screen.

3. A screen tensioning and printing frame as claimed in claim 2 wherein the reapportioning means also adjusts the position of the opposing means.

4. A screen tensioning and printing frame as claimed in claim 3 wherein the reapportioning means further comprises biasing means for providing a countering force to the reapportioning means, the countering force directed in the same direction as the screen tension.

5. A screen tensioning and printing frame as claimed in claim 4 wherein the countering means contacts the roller on the same end as the reapportioning means.

6. A screen tensioning and printing frame as claimed in claim 5 wherein the reapportioning means contacts the opposing means.

7. A screen tensioning and printing frame as claimed in claim 1 wherein the locking means engages the rollers with the corner members.

8. A screen tensioning and printing frame as claimed in claim 1 wherein the reapportioning means further comprises biasing means for providing a countering force to the reapportioning means, the countering force directed in the same direction as the screen tension.

9. A screen tesnioning and printing frame as claimed in claim 1 further comprising means attached to the corner members for preventing undesired inward bowing of the rollers upon tensioning of the screen.

10. A screen tensioning and printing frame as claimed in claim 9 wherein the bearing head is attached to the set screw to permit swiveling of the head such that the bearing head remains in flush contact with the bowing prevention means.

11. A screen tensioning and printing frame as claimed in claim 1 further comprising biasing means attached to the corner member, the biasing means providing a biasing force against the roller toward the bearing head of the set screw.

12. A screen tensioning and printing frame as claimed in claim 11 wherein the biasing means further comprises a hollow shaft, a plug which projects from the hollow of the shaft, a spring supporting the plug, the biasing force of the spring projecting the plug into contact with the roller to cause movement thereof when released from its engagement with the corner member and during adjustment by the reapportioning means.

* * * * *